US005449156A

United States Patent [19]

Gnuechtel et al.

[11] Patent Number: 5,449,156

[45] Date of Patent: Sep. 12, 1995

[54] METHOD AND APPARATUS FOR LONGITUDINALLY FOLDING A PRINTED WEB IN A PRINTING PRESS

[75] Inventors: Herman C. Gnuechtel, Arlington Heights; Thomas H. Schumacher, Downers Grove, both of Ill.

[73] Assignee: Web Printing Controls Co., Inc., Lake Barrington, Ill.

[21] Appl. No.: 118,992

[22] Filed: Sep. 9, 1993

[51] Int. Cl.[6] ..... B41F 13/58; B65H 23/08

[52] U.S. Cl. ..... 270/5; 226/195

[58] Field of Search ..... 270/5, 6, 7, 8, 9, 10, 270/20.1, 41, 42; 226/42, 44, 195; 242/418.1; 493/23, 24, 29, 439

[56] References Cited

U.S. PATENT DOCUMENTS

| | | | |
|---|---|---|---|
| 3,955,737 | 5/1976 | Traise | 226/195 X |
| 4,050,361 | 9/1977 | Traise | 493/439 X |
| 4,231,560 | 11/1980 | Stohlquist et al. | 493/439 X |
| 4,395,255 | 7/1983 | Branecky et al. | 493/439 |
| 4,775,086 | 10/1988 | Kataoka | 226/44 |
| 4,848,630 | 7/1989 | Niestrath et al. | 226/44 X |
| 4,986,806 | 1/1991 | Braedle et al. | 493/439 X |
| 5,137,505 | 8/1992 | Ishii et al. | 493/439 X |
| 5,176,334 | 1/1993 | Dreschau et al. | 242/75.5 |
| 5,176,371 | 1/1993 | Rau et al. | 270/41 X |

*Primary Examiner*—John E. Ryznic

*Attorney, Agent, or Firm*—Greer, Burns & Crain, Ltd.

[57] ABSTRACT

A method and apparatus for longitudinally folding a printed web upstream of the former or other finishing device in an in-line printing press. The invention permits plow folding to be accomplished upstream of the former by carefully controlling the tension of the web while it is in the plow folding apparatus.

40 Claims, 2 Drawing Sheets

METHOD AND APPARATUS FOR LONGITUDINALLY FOLDING A PRINTED WEB IN A PRINTING PRESS

The present invention generally relates to the art of web printing, and more particularly relates to longitudinally folding a web of printable material as it travels through a web printing press.

It is well known that in-line web printing presses are used to print many kinds of printed materials, including magazines and newspapers. These printing presses can print extremely high quality printed material on high quality heavy stock paper webs that inherently have high strength characteristics.

When heavy stock paper is used in this type of press, the range of values of acceptable tension that the web encounters while it is run through the printing press can be quite large without experiencing breakage of the web. On the other-hand, when newspapers are being printed on various newsprint grades of paper, the tension levels that can be applied to the web are considerably less than are possible with the thicker webs.

While the tension levels that can be applied to the heavier grade paper webs can be much greater than that applied to newsprint, web breakage in the press is a concern regardless of the strength of the paper web being printed. This is due in part because of the nature of paper in that if tension is evenly distributed across a web being printed, which may be 55 inches or more, the web may be capable of withstanding tension levels in excess of ten pounds per lineal inch. This can result in a tension totaling more than 500 pounds for a 55 inch wide web.

For much lighter grades of paper, such as newsprint, the tension levels may approach four pounds per lineal inch of width before the web would break. However, the nature of the force being applied to webs as they are run through a printing press is such that a malfunction of the press will result in an uneven application of tension to the web being applied. In fact, it is generally the rule rather than the exception that forces that are applied during the printing process in an in-line web printing press which results in a breakage of the web is a result of a focusing of force on a very small area of the web which causes it to break. Once the web is initially broken, the forces often cause the break to rapidly spread and extend across the entire web and completely sever it.

It is common and well known in the printing art to apply water to a web during the printing process for the purpose of isolating the ink, since many commonly used inks do not mix with water. This is generally the case in the printing of newspapers and the water is sprayed onto the impression cylinder in the printing unit once the printing press reaches a predetermined operating speed during startup of a printing run.

The initial spraying of the impression cylinder often results in a greater amount of water being initially applied and the water can accumulate in the gap between the plates where they are attached to the impression cylinder. This results in a wicking action by the web which removes the water from the gap during operation. It also causes a line of wetness to occur in the web which extends across at least a large portion of the width of the web for a number of impressions, which may approach six or seven impressions before the water is removed from the gaps.

The presence of this line of wetness has the undesirable result of substantially reducing the tensile strength of the web across such a line. For larger webs which may approach or exceed 55 inches in width, it is common to offset the printing plates along the printing roller into two distinct sections so that a single gap will not extend across the entire width in a single line. Thus, if they are offset on a half-to-half relationship, then a gap at a single longitudinal location would only extend across approximately one-half of the web. This generally provides sufficient insurance against fracturing of the web due to the wetness that may be present.

Once the press continues to increase in operating speed, the water accumulation is generally not experienced. Thus, the water accumulation is generally a startup problem, but could be a significant one if less than a full web were being printed, or if there were no effective offsetting of the gap in the longitudinal direction for a web or web portion that was being processed through a printing press and which experienced considerable tension forces.

It is also known and common in the web printing art that one or more webs are printed by various printing units and then be combined in a forming station. A forming station may receive multiple webs and split the web into two or more smaller dimensioned widths and then apply those widths to a folder which folds the web portions being fed to it into smaller sections, such as the sections of a newspaper.

The forming station then cuts the web into discrete lengths and applies additional folds to make a folded newspaper. The web is supplied by one or more supply rolls which feed the web to the printing units and the web is then run to the former. The supply rolls generally have a means for applying a resistive force to the unwinding of the web from the rolls and this has the effect of applying tension to the web throughout the printing press. However, the forming means generally applies the greatest tension to the web and in a newspaper printing operation, the forming or former means can apply tension to the web that may range from approximately one-half pound per lineal inch to two pounds per lineal inch. Thus, for a 55 inch web, the tension applied to the entire web could range from 27 to 110 pounds. Obviously, if the web is split into two half sections, the tension for each half section would be approximately 13½ pounds to approximately 55 pounds.

The design of the forming means is such that tension is generally uniformly distributed and tension for a full 55 inch web may be within the range of 27 to 110 pounds on the web. This would be approximately 13 to 55 pounds if the web were split into two sections of approximately 27½ inch width. A 27½ inch width web would then be folded into two equal sections and would generally result in four pages of a newspaper.

Modern printing presses generally accommodate up to four forming units which results in a maximum of eight sections that can be simultaneously printed. If more sections are to be printed, then it has to be done on a separate press or has to be done subsequently on another press run of the same press and the additional sections then must be combined with the sections made during the original press run. While it may be possible to put in additional printing units and additional forming units to the location where the other forming units are present, this requires a much higher elevation in the press room which is usually not present and the roof may literally have to be raised to accommodate such a construction. The cost of such reconstruction is often considered prohibitive.

If, however, a longitudinal fold can be applied to a printed web upstream of the formers, the folded product could be combined at the former and additional sections of a newspaper, for example, could be printed by the same printing press during a single press run. To accomplish such a longitudinal fold, it has been contemplated to use a plow folding mechanism to fold one or two webs after they have been printed, but it is easier said than done because of the concentration of force that occurs in a plow folding structure, whether it be a rotary plow folder or a plow folding shoe.

Due to the fact that a web can be folded over onto itself to form four pages of a newspaper or if two webs were folded to produce an eight page section, the inherent nature of a plow folder results in one-half of the web being folded not having any tension whatsoever applied to it during the folding operation. Thus, the tension that would otherwise be present in the complete web would be concentrated to one-half of the web, thereby doubling the tension per lineal inch being applied to the web. Because of the relatively low strength of newsprint, such plow folding efforts have not been successful.

The attempts have been exacerbated by the fact that a web that is to be folded would necessarily have a width whereby the printed indicia would extend across the entire width being folded and any gap between the impression plates would extend the full width of the web. Thus, if water were present in the gap, which would decrease the strength of the web, then a break could easily occur during the folding operation or downstream of it toward the former.

Accordingly, it is a primary object of the present invention to provide an improved method and apparatus for longitudinally folding a web of printable material in a printing press upstream of a forming unit.

Another object of the present invention is to provide an improved method and apparatus for applying a longitudinal fold to one or two webs of an in-line printing press downstream of the printing units at a location between the printing units and an output unit, such as a forming unit.

A more detailed object is to provide such a method and apparatus for plow folding a relatively fragile web such as newsprint in a newspaper printing press wherein the folding is performed at a location between the printing unit and the newspaper forming unit.

Another object of the present invention is to provide such an improved method and apparatus for longitudinally folding a web of printed material, which apparatus can be retrofitted into existing printing presses without requiring any significant modification to the printing presses or any structural change to the building in which the press is located.

Another related object of the present invention is to provide such a method and apparatus which effectively controls the tension of the web in a folding zone.

Yet another related object is to provide such a method and apparatus whereby the tension levels that are normally experienced in the printing press are relatively unaffected, but the web within the folding apparatus is isolated and controlled so that folding can be accomplished reliably and accurately.

Still another object of the present invention is to provide such an improved method and apparatus for longitudinally folding the web in an in-line printing press prior to the folding unit by precisely controlling the tension of the web when the web is in a folding zone that is defined by isolating the tension within the zone from both the upstream and downstream portions of the web outside of the zone.

Another object of the present invention is to provide such an improved apparatus which utilizes a processing means that contains a control algorithm that utilizes proportional, integral and derivative terms for accurately controlling the apparatus so that the tension in the web within the folding zone can be controlled within close tolerances.

Yet another object of the present invention is to provide such an improved method and apparatus which effectively controls the tension in the web to vary the tension both within the folding zone and downstream thereof in a manner whereby tension is maintained at a lower level than during normal operation for a web that has been initially sprayed with water during startup of the press, or during a jogging or other slow press speed operation. This enables a portion of the web to clear the press at lower tension levels to minimize the potential for breakage.

Still another object of the present invention is to provide such an improved method and apparatus which folds two combined webs at a folding zone, and yet controls the tension of the combined webs in a manner whereby a predetermined maximum desirable tension on either of the separate webs is not exceeded.

Other objects and advantages of the present invention will become apparent upon reading the following detailed description, while referring to the attached drawings, in which.

DETAILED DESCRIPTION

Broadly stated, the present invention is directed to a method and apparatus for longitudinally folding a web of printed material within an in-line printing press. The method and apparatus is adapted for use in a conventional in-line printing press that is of the type which has a web supply unit, a plurality of printing units, typically four color printing units, and a former unit located at the downstream end of the printing press.

The apparatus of the present invention is positioned downstream of the printing unit and upstream of the former unit or other output unit. The method and apparatus is adapted to control the tension of the web within the folding apparatus which may be referred to as a folding zone where the one web (or two combined webs) is folded in the longitudinal direction.

While the apparatus is preferably used during the printing of the web in a printing press, it is also contemplated that the web being folded can be preprinted and then be run through the folding unit and combined with other webs.

The apparatus effectively isolates the tension of the web within the folding zone so that its tension is reduced relative to the tension that is normally present in the web upstream of the folding zone as well as downstream of it. This is accomplished by securing the web at an input cylinder as well as an output cylinder and carefully controlling the speed of either the input cylinder and/or output cylinder in a manner whereby the tension within the folding zone is maintained at a predetermined range of values. This is accomplished by sensing the tension in the web at one or more locations, preferably in the input side of the folding zone, i.e., the tension in the web after it leaves the input cylinder. The web is preferably secured by wrapping the web over the cylinders. However, it should be understood that it can also be secured by utilizing a nip roller in combination with the input cylinder as well as the output cylinder to impinge the web and thereby hold it.

The input cylinder as well as the output cylinder are preferably driven by drive means that are controlled by electrical signals generated by processing means that utilizes as its input the measured tension in the web downstream of the input cylinder. By driving the output cylinder which is designed to grab the web relatively tightly so that it will not slip on the surface of the output cylinder, the tension upstream of the output drive cylinder can be reduced relative to the downstream side and in this way, control the tension within the web. The tension can also be controlled by driving the input cylinder at a speed that is carefully controlled relative to the web speed.

Figure 1:
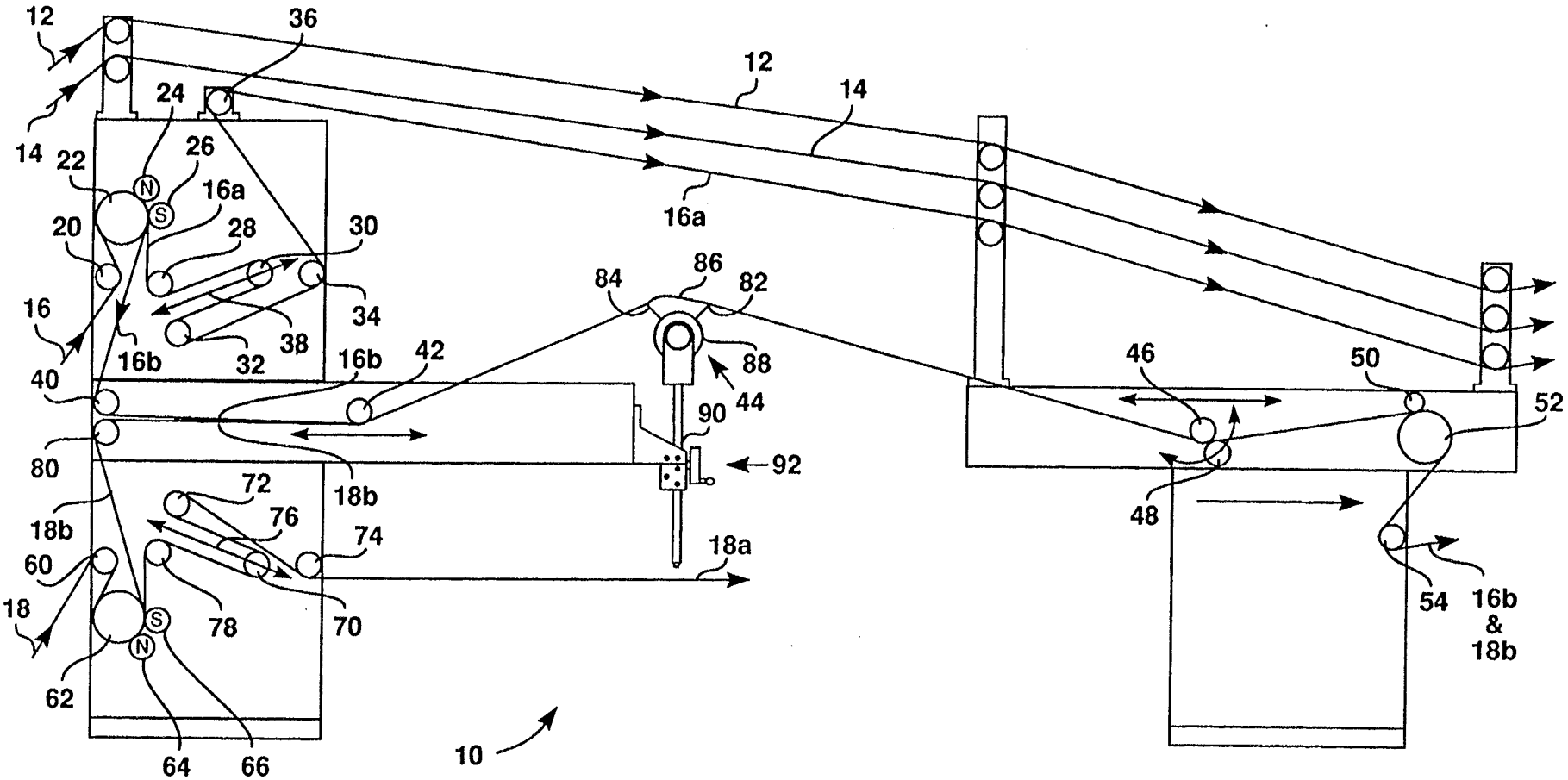
FIG. 1 is a side view of apparatus embodying the present invention.

Turning now to the drawings, and referring to FIG. 1, a folding unit, indicated generally at 10, is shown and is adapted to receive one or more webs of paper at the left side which move through the apparatus 10 to the right side where the webs would pass to downstream units, such as a forming unit, an in-line finishing unit or other type of output unit. The apparatus 10 has four webs being fed to it, namely webs 12, 14, 16 and 18. The webs originate from supply rolls 15 and are fed through printing units 17 where printing is done before the webs reach the apparatus 10 of the present invention. The webs then are fed to an output device such as a former or forming unit 19.

It should be understood that the webs 12 and 14 are webs that come from the individual printing units 17 and are not folded so they are merely bypassed above the apparatus 10 and would pass to downstream portions of the printing press, such as the former unit 19. The web 16 is introduced to the apparatus 10 by passing beneath a roll 20 and over roll 22. The web is nipped by a roll 24. A slitter mechanism 26 slits the web into two segments, one of which is identified as web **16*a* and this web passes around roll 28, 30, 32, 34 and 36** where it is fed to the downstream portions of the printing press, such as the former.

The roll 30 is moveable in the direction of the arrows 38 for the purpose of adjusting the position of the web relative to other webs so that the printed indicia is properly aligned when it reaches the downstream portion of the printing press.

The other portion of the web is identified as **16*b* and this web passes around roll 40, as well as roll 42 where it then is fed to a folding means, indicated generally at 44, where the web is longitudinally folded onto itself. The folded web is then fed to an adjustable nip defined by rolls 46 and 48 and it then passes under roll 50 and wraps around exit drag roll 52 and roll 54**, where it exits to the downstream portion of the printing press.

If two webs are being folded, then the web 18 would be introduced to the apparatus 10 as shown in FIG. 1. However, if only one web were being folded, then the web 18 would not be present. If web 18 is present, it is wrapped around a roll 60 as well as roll 62 that is held by a nip roll 64. The slitter 66 slits the web 18 into two separate widths **18*a* and 18*b*. Web 18*a* is passed around rolls 68, 70, 72 and 74 where it exits the apparatus 10 and is fed to the former or other output device. As in the case of the roll 30, roll 70 is movable in the direction of the arrows 76 for adjusting the position of the web relative to other webs that are fed to the former. The web portion 18*b* is fed to a roll 80 where it is aligned and brought into contact with the web 16*b* so that two layers of web will be applied to the folding station 44** where they are folded.

The folding means 44 has a folding shoe 82 over which the web or webs travel with the shoe 82 having an arcuate portion 84 for initially receiving the web and a flat portion 86 which merges with the curved portion 84. As shown in FIG. 1, the shoe 82 is supported by a mounting structure 88 and it is connected to a rod structure 90 that is operatively connected to an adjusting means, indicated generally at 92, which has a handle that permits the entire structure to be raised or lowered to change the angular orientation of the web relative to the shoe 82. The web portion that is to be folded under will not contact the shoe 82 so that the upper portion of the web which does contact the shoe must support the full tension that is applied by the apparatus. The side not in contact has no tension applied to it and it folds underneath the upper portion in a manner that is well known in the plow folding art. While the shoe construction is shown, it should be understood that a rotary plow construction can be used, and in that event the structure 88 may rotate and be in contact with the web. The structure 82, 84 and 86 shown would not be present with such an embodiment. It is also contemplated that a combination of a rotary plow and a shoe can be used.

In accordance with an important aspect of the present invention, the portion of the webs **16*b* and/or 18*b* that are within the folding apparatus 10 are effectively isolated from the standpoint of tension from both the portion of the webs that are upstream of the input rolls 22 and 62 as well as downstream of the output or exit drag roll 52. This is accomplished on the input by wrapping the web 16 around roll 22 through an arcuate path of approximately 180° which is similarly done with respect to the web 18 being wrapped around roll 62. This effectively isolates the tension on the upstream side from the tension of the web that exits the rolls 22 and 62**.

Similarly, the exit drag roll 52 in combination with the roll 54 isolates the output tension of the web from the tension upstream of the roll 52. This is in part due to the fact that the exit drag roll 52 is preferably provided with an abrasive surface to prevent the web from slipping during operation. In this regard, the abrasive surface of the roll 52 can be achieved by various means, preferably such as by applying a carbide material to the surface. Alternatively, diamond particles may even be used to provide an extended wear surface. A sandpaper surface, while not expected to provide for the desired extended wear, could have a longer useful life if the sandpaper has a spring steel substrate rather than a cloth substrate. As an additional alternative, the surface of the roll 52 may be knurled or provided with a grated wrap type of material, although the carbide abrasive surface is preferred.

Figure 3:
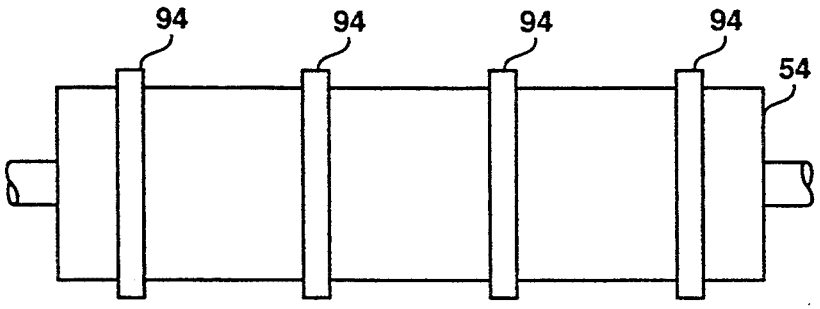
FIG. 3 is a plan view of one roll that is part of the present invention.
Figure 4:
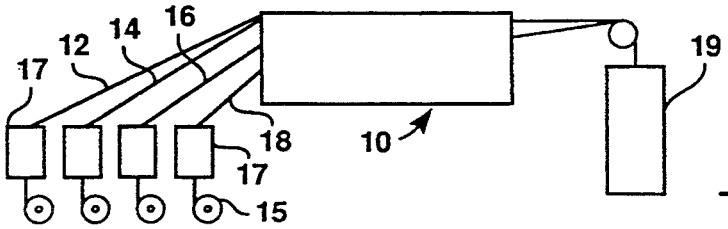
FIG. 4 is a block diagram of a printing press having the apparatus embodying the present invention installed.

It is also preferred that the surface of the roll 54 have a number of outwardly extended or ribbed portions 94 as shown in FIG. 3. It has been found that these rib portions prevent web breakage of newsprint particularly when two webs 16*b* and 18*b* are folded together. It should be understood that one of the webs will be completely sandwiched between outer layers of the other web and when the combined webs are wrapped around a cylinder, the layers that are furthest away from the cylinder surface must travel farther than the inner layers. This has been found to create tension problems that has resulted in slippage of the trapped or inside web relative to the other and eventually resulted in a web break. By using the ribbed cylinder 54 at the location illustrated, the problem is substantially eliminated.

In accordance with another important aspect of the present invention, the exit drag roll 52 is driven at a speed that is carefully controlled to achieve the desired tension control of the web being folded while it is in the apparatus 10. By virtue of the effective tension isolation that is achieved by rolls 22, 62 and 52, the speed that the roll 52 is driven can be used to adjust the tension of the web that is passing over the folding means 44. Stated in other words, if the roller 52 is driven slightly slower than the web would otherwise travel between the printing units which are upstream of the apparatus 10 and the former which is downstream of the roll 52, the tension in the web within the apparatus, i.e., within the folding zone or folding station, can be reduced.

Conditions within printing presses can change dramatically depending upon the operating conditions and other circumstances. The modulus and stretchability of paper will change depending upon the amount of ink and the amount of water that is applied to the web. The conditions will also change depending upon the direction of fiber in the paper, the thickness of the paper, as well as the temperature and humidity within the press room. All of these factors affect the tension that may be present in the web. Additionally, the setting of the former and other settings within the press will have an effect on the tension of the web.

It is common that a tension level on the order of 40 pounds would be applied upstream of the former. When a press is being set up, the supply rolls which generally uniformly have a tension applying mechanism, usually do not apply tension to the press until the paper is threaded through the former. Once this is completed, then tension is applied to the supply reels to provide a desired tension on the web. On one commonly used structure, the tension is applied on the supply reels by tightening bands which contact the outer surface of the roll of paper to resist it feeding the web to the printing units, with the amount of force being applied to the bands controlling the amount of tension that is produced.

In accordance with the present invention, a tension level on the order of 40 pounds is unacceptably high and will generally result in breakage of the web. This is due in part because the portion of the web that is folded is less than the full width, often ½ of the web 16 or 18 and that ½ web portion 16*b* and 18*b* which is folded effectively has the tension concentrated in the upper side of the web when it passes over the folding shoe 82. This concentration of tension necessarily creates additional breakage problems if the tension of the web within the apparatus is not reduced.

To this end, the apparatus of the present invention has a control system for controlling the feed by which the exit drag roll 52 operates to achieve a tension of the web that is applied to the folding means 44 within the range of approximately 6 to 13 pounds, and preferably about 10 pounds during production in the printing of a newspaper. This is a significant reduction in tension compared to the 40 pound level that may be present at the former.

To control the tension of the web in the apparatus 10, load cells or tension transducers are used to measure the tension at one or more predetermined locations within the apparatus. While the tension may be sensed at a location near the input or the output, or both, one preferred embodiment has load cells operatively connected to rolls 22 and 62 for measuring the tension at the input to the apparatus 10. As is generally known to those skilled in the art, the load cells should be applied at a location whereby the angle of the web will not change during operation and for this reason, the rolls 22 and 62 have a constant angular orientation of wrap of the web around these rolls.

It is preferred that the tension in the web 16*b* and 18*b* which are the portions that are downstream of the rolls 22 and 62 be at a tension of approximately 10 pounds which compares to a commonly applied tension upstream of these same rolls that is in the neighborhood of approximately 18 pounds. While the apparatus embodying the present invention is effective to operate reliably with tension being measured in the web at the input by the tension transducers located in cooperation with rolls 22 and 62, a tension sensor transducer could be connected to the exit drag roll 52 or even on the folding mechanism 44 itself.

When the press is started up, it is necessary to hold the web at the exit drag roll 52 for a time until the press increases in operating speed so that tension levels are stabilized. To hold the web during startup, the roll 50 is controllable to apply a variable force to the web and hold the web tightly to the surface of roll 52. Once the press reaches a predetermined operating speed, the cylinder 50 is preferably released so that it is out of contact with the web during normal operation. It should be understood that the threshold speed at which the roll 50 is removed can be sensed and the retraction of the roll 50 can easily be automatically controlled.

Figure 2:
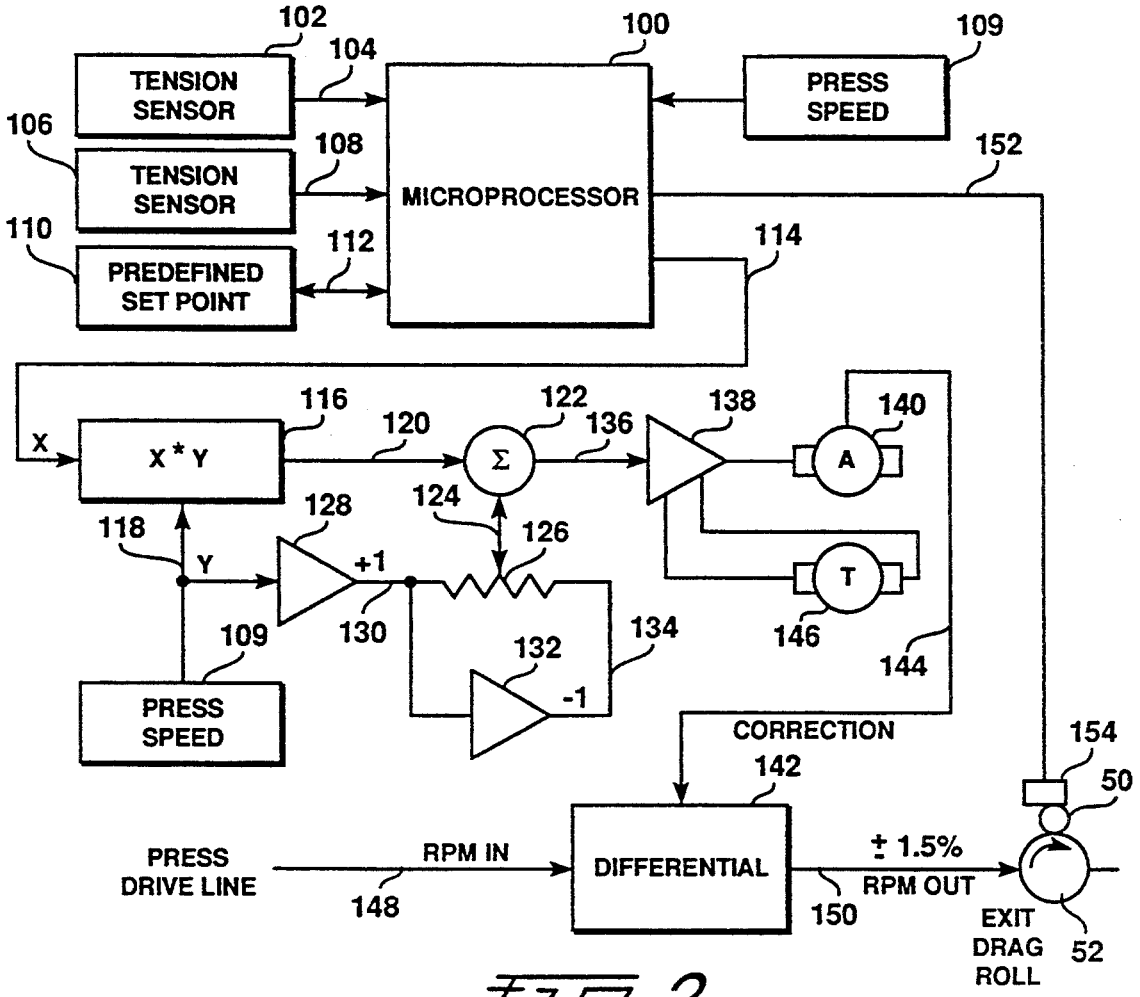
FIG. 2 is a block diagram of the control circuitry that is part of the apparatus of the present invention.

In accordance with another important aspect of the present invention and referring to FIG. 2, there is a block diagram of the control circuitry that is used to control the tension of the web within the apparatus, which can be considered a folding zone or station. The circuitry comprises a processing means which is preferably a microprocessor 100 which functions as a controller for controlling the speed of operation of the exit drag roll 52 as well as other functions.

The microprocessor 100 receives signals from a tension sensor 102 via line 104 with the tension sensor 102 being a tension transducer that is operatively connected to the roll 22. A second tension sensor 106 associated with the roll 62 provides an electrical signal on line 108 that is indicative of the tension of the web 18*b* and it is also applied to the microprocessor 100. The microprocessor 100 also receives a signal indicative of the press speed from a tachometer or the like 109, which may the same as that indicated in the lower left portion of FIG. 2.

A predefined set point is shown by block 110 and it is interconnected via line 112 to the microprocessor 100 and this defines the input tension of the web 16*b* and 18*b*. Given the fact that the input tension of the web 16 and 18 that are fed to the apparatus 10 is generally approximately 18 pounds, the set point is the value which corresponds to the tension level that is desired, which is preferably in the range of approximately 10 pounds. However, the line 112 is shown with arrows in both directions for the purpose of having the microprocessor 100 change the set point as a function of press speed, if desired. When the press is initially started up, it is preferred that the tension in the web be reduced below 10 pounds until the operation stabilizes and when it is running faster, the tension can be gradually increased. However, the range of desirable tension is within 7 to approximately 12 pounds.

The microprocessor 100 performs a controlling function and the control algorithm that is embedded in associated memory of the microprocessor is preferably a proportional/integral/derivative controller which produces a control signal on line 114 which extends to a multiplier 116 that varies the control signal as a function of press speed. The control signal on line 114 is multiplied by a signal on line 118 that is also applied to the multiplier 116 and an output signal is produced on line 120 that extends to a summing junction 122, the other input of which is provided by a line 124 from a potentiometer 126. The potentiometer 126 is connected to the output of an amplifier 128 having a positive gain of 1. The output of the amplifier 128 appears on line 130 and this is applied to one end of the potentiometer 126 as well as to another amplifier 132 having an output gain of −1 on line 134 and this is connected to the other end of the potentiometer 126. The summing junction 122 provides an output signal on line 136 that is applied to an amplifier 138 that drives a servo motor, the armature 140 of which is mechanically attached to a mechanical differential 142 via a mechanical connection schematically illustrated by line 144. A tachometer 146 provides a tach signal to the amplifier 138.

The press drive line is physically connected to the differential 142 and is schematically illustrated by line 148 and the correction signal being applied by connection 144 results in the output shaft of the differential which is schematically illustrated by line 150 and which connects to the exit drag roll 52 drives the roll 52 at a speed that can vary up to 1½% faster or slower relative to the press drive speed represented by line 148.

Since the speed of the web that is traveling through the apparatus of the present invention is effectively controlled by the rotation of the exit drag roll 52 and since the speed of the web when last controlled before the web is applied to the input of the apparatus 10 is that which is controlled by the blanket roll within the printing unit, it is desirable if not necessary to match the speed of the outer surface of the blanket roll to the surface speed of the exit drag roll. This can be accomplished by the potentiometer 126 in the circuit having the plus and minus unity gain amplifiers 128 and 132.

While the correction signal from the microprocessor mechanically controls a differential which effectively adds or subtracts revolutions per minute to the press drive line 148, the illustrated circuitry is dependent upon the use of a press drive line or an extension of it to drive the exit drag roll. However, it should be understood that the exit drag roll can be driven by a D.C. motor which would eliminate the need to extend the press drive line to the folding apparatus. The recently developed flux vector drive technology results in D.C. motors that have superior control capability and can be used in place of a mechanical drive of the type illustrated in FIG. 2.

As previously mentioned, the microprocessor 100 utilizes a closed loop control that includes a proportional/integral/derivative control loop to generate the control signal on line 114. The proportional term is defined by the equation $$\text{P-term} = K_p * e(n)$$

where $e_n$ is said input error signal which is the difference between the signal that is indicative of the tension sensed by either sensor 102 or 106 relative to the predefined set point as determined by the block 110. The proportional gain factor $k_p$ is preferably approximately 0.7.

The derivative term is defined by the equation $$\text{D-term} = K_d * (e(n) - e(n-1))/T_s$$

where e(n) is the difference between said measured tension and said predetermined tension at sample time "n"; e(n−1) is the difference at the previous sample time; and $T_s$ is the sampling period. While sampling at a faster rate such as 100 samples per second results in more data being processed during operation, it has been found that sampling at a rate of 10 samples per second is effective to provide reliable control. The gain factor for the derivative term is relatively small and may be on the order of 0.02 during operation.

With respect to the integral term, it is defined by the equation $$\text{I-term} = (K_i * e(n) * T_s) + \text{I-term}(n-1)$$

where e(n) is the difference at sample time "n"; I-term(n−1) is the I-term calculated at the previous sample time; and $T_s$ is the sampling period, and in practice, an integral gain factor $k_i$ is preferably approximately 0.6. However, it should be understood that the gain factor $k_i$ does not have to be constant, and may desirably vary depending upon operational considerations. With regard to the gain factor $k_i$, it may desirably change as a function of web or press speed, i.e., the factor would be decreased as the press speed increased. This gain factor $k_i$ may be zero, which would effectively remove it as a controlling influence.

As previously mentioned, the application of force being applied by the roll 50 can be automatically controlled by the microprocessor 100 as a function of detected press speed from block 108 which represents a tachometer signal and the microprocessor 100 can apply a signal on line 152 to a retraction mechanism schematically illustrated by block 154.

In accordance with yet another important aspect of the present invention, it should be appreciated that when two webs are applied to the folding means 44, they are combined into a single web as seen by the exit drag roll 52. If the tension of each of the webs is measured, then the presence of the two webs will result in the exit drag roll 52 applying a greater force to the combined webs. Thus, if the tension on each web is measured at the input at the desired value of approximately 10 pounds, then the exit drag roll 52 would apply a total of 20 pounds. However, if the input tension of the two webs is unequal, such a 20 pound tension could break one of the webs which had a higher input tension. In the event the webs are unevenly tensioned, the microprocessor 100 will compare the measured tension, and will not apply a tension that represents the sum of the two tension values, and in fact will not exceed the 10 pound tension level. This insures that the web will not be broken by excessive tension being applied.

In accordance with yet another aspect of the present invention, the microprocessor 100 has the capability of controlling the tension of the web during jogging and/or startup when breakage of the web can occur due to high web tension aberrations or web strength reducing conditions. For example, the presence of water in the gap between the printing plates may be present. If water is present, then the strength of the web may be compromised for several impressions, perhaps six to seven of them. Since the portion of the web that is being folded will necessarily have a gap that extends across the full width of the web being folded, the presence of water may easily result in a web break. Since the microprocessor 100 receives a press speed signal, and since the initial application of water is known to occur at a particular press speed, the microprocessor 100 can reduce the tension in the web downstream of the exit drag roll for a period of time that is sufficient to pass the portion of the web which contains the six or seven impressions that may have excessive water on the web to minimize the possibility of a web break. Once that portion of the web passes through the former, the tension control can be adjusted to normal running conditions.

Similarly, there are press running conditions that can result in web breakage, such as during operation in a jog mode of the press or during slow running during startup before the impression rolls are 'on impression'. These circumstances are independent of the water problem discussed above. In such circumstances, there can be excessive tension applied to the web which has the potential for breaking the web. The microprocessor 100 can control the drag roll 52 to pull more paper through the apparatus of the present invention and thereby reduce the tension of the web between the drag roll 52 and the former, as well as within the apparatus itself. When the press is then put 'on impression' and brought up to a normal running speed range, the appropriate tension levels are established as previously discussed.

From the foregoing, it should be appreciated that an improved method and apparatus for longitudinally folding a web within a printing press has been shown and described which has many significant advantages. The invention is effective to provide greater production from a printing press and can significantly reduce operating costs. The invention is reliable in its operation, even though relatively fragile paper webs can be used, because of the novel and sophisticated tension control that is accomplished.

While various embodiments of the present invention have been shown and described, it should be understood that various alternatives, substitutions and equivalents can be used, and the present invention should only be limited by the claims and equivalents of the claims.

Various features of the present invention are set forth in the following claims.

What is claimed is:

1. Apparatus for folding at least one longitudinal web of material in the longitudinal direction after the web has been printed at a printing station, said folding apparatus being adapted for use in a printing press, and outputting means for forming the web into segments of printed material, said folding apparatus comprising:

means for folding said web along its longitudinal direction, said folding means having a folding structure adapted to contact said web as it is drawn thereon;

means for isolating the tension of the web being fed to the folding apparatus from the tension of the web downstream of said isolating means;

means for outputting the web from said folding apparatus, said outputting means being adapted to provide the web with a first predetermined tension between said outputting means and said isolating means, said first predetermined tension being lower than the tension of the web upstream of said isolating means and downstream of said outputting means.

2. Apparatus as defined in claim 1 further including first means for measuring the tension of the web at least at a first predetermined location between said isolating means and said outputting means, and generating electrical signals that are indicative of the measured tension.

3. Apparatus as defined in claim 2 wherein said outputting means comprises a rotatable output cylinder means over which the web is secured, said output cylinder means being effective to vary the tension of the web upstream of said output cylinder means relative to the tension of the web downstream of said output cylinder means.

4. Apparatus as defined in claim 3 further including means for driving said output cylinder means at a controllable rotational speed responsive to control signals being applied thereto.

5. Apparatus as defined in claim 4 further including processing means adapted to receive said electrical signals from said tension measuring means and generate said control signals to cause said driving means to drive said output cylinder means at a rotational speed that will produce said first predetermined tension in the web between said output cylinder means and said isolating means.

6. Apparatus as defined in claim 4 including processing means including memory means for retaining data and instructions for producing said control signals, said processing means receiving said electrical signals that are indicative of the measured tension and comparing said signals with a signal that is indicative of a predetermined variable tension value, said processing means producing control signals for reducing any difference between said measured tension and said predetermined variable tension value.

7. Apparatus as defined in claim 6 wherein said control signals comprise the sum of a proportional term, a derivative term and an integral term, with the respective terms having associated gain factors $K_p$, $K_d$, and $K_i$.

8. Apparatus as defined in claim 7 wherein said proportional term of said control signal is defined by the equation:

$$\text{P-term} = K_p * e(n)$$

where e (n) is the difference between said measured tension and said predetermined tension.

9. Apparatus as defined in claim 7 wherein said derivative term of said control signal is defined by the equation:

$$\text{D-term} = K_d * (e(n) - e(n-1))/T_s$$

where e(n) is the difference between said measured tension and said predetermined tension at sample time 'n';

e(n−1) is the difference at the previous sample time; and $T_s$ is the sampling period.

10. Apparatus as defined in claim 7 wherein said integral term is defined by the equation:

$$\text{I-term}=(K_i*e(n)*T_s)+\text{I-term}(n-1)$$

where:

e(n) is the difference at sample time 'n';

I-term (n−1) is the I-term calculated at the previous sample time; and $T_s$ is the sampling period.

11. Apparatus as defined in claim 7 wherein said predetermined tension varies as a function of the speed of operation of the printing press and other printing press operating conditions.

12. Apparatus as defined in claim 2 wherein said input isolating means comprises an input cylinder over which the web is secured.

13. Apparatus as defined in claim 12 wherein said web is secured by wrapping the same around said input cylinder approximately 180 degrees.

14. Apparatus as defined in claim 12 wherein said web is secured by nipping the web between a nip cylinder and said input cylinder.

15. Apparatus as defined in claim 12 wherein said first tension measuring means comprises a load cell operatively connected to said input cylinder, said load cell being adapted to generate an electrical signal proportional to the radial force being applied to the cylinder by the web.

16. Apparatus as defined in claim 3 wherein said first tension measuring means comprises a load cell operatively connected to said output cylinder means, said load cell being adapted to generate an electrical signal proportional to the radial force being applied to the cylinder by the web.

17. Apparatus as defined in claim 3 wherein said outputting means includes a pressure cylinder means adjacent said output cylinder means adapted to apply a force toward said output cylinder means for securing the web firmly against said output cylinder means.

18. Apparatus as defined in claim 17 wherein said output cylinder means has an abrasive surface adapted to resist slippage of the web relative to said surface when the web is in contact with said surface.

19. Apparatus as defined in claim 2 further including a second tension measuring means for measuring the tension of the web at a second predetermined location near and on one of the upstream and downstream sides of said outputting means, and generating electrical signals that are indicative of the measured tension.

20. Apparatus as defined in claim 19 wherein said second tension measuring means comprises a load cell operatively connected to said output cylinder means, said load cell being adapted to generate an electrical signal proportional to the radial force being applied to said output cylinder means by said web.

21. Apparatus as defined in claim 2 wherein said apparatus is adapted to receive at least one additional web that can be combined with said web so that at least two webs are folded by said folding means, said another web being applied to said second tension measuring means for measuring the tension of said another web at a second predetermined location near said first tension measuring means, and generating electrical signals that are indicative of the measured tension of said another web.

22. Apparatus as defined in claim 1 wherein said folding structure comprises a plow folding means having a generally arcuate portion and a generally flat portion connected thereto, the web being introduced to the arcuate portion where the web is begun to be longitudinally folded and the folding is substantially completed on the flat portion.

23. Apparatus as defined in claim 1 wherein said folding structure comprises a plow folding means having a rotary portion adapted to contact the web in the area of the longitudinal fold, the web being introduced to the rotary portion where the web is longitudinally folded.

24. Apparatus for folding at least two longitudinal webs of material in the longitudinal direction after the web has been printed at a printing station, said folding apparatus being adapted for use in a printing press of the type which has a plurality of printing stations, and means for forming the web into segments of printed material, said folding apparatus comprising:

means for isolating the tension of each web being fed to the folding apparatus from the tension of the webs downstream of said isolating means;

means for combining said webs in overlapping relation;

means for folding said webs along their longitudinal direction, said folding means having a folding structure adapted to contact said combined webs as they are drawn thereon;

means for outputting said folded webs from said folding apparatus, said outputting means being adapted to provide each of the webs with a desired tension level between said outputting means and said isolating means, said desired tension being lower than the tension of the web upstream of said isolating means and downstream of said outputting means.

25. Apparatus as defined in claim 24 wherein said outputting means comprises an exit drag roll means around which said combined webs are wrapped and output drive means for driving said exit drag roll means at a controllable speed responsive to control signals being applied thereto.

26. Apparatus as defined in claim 25 including means for sensing the tension in each of said webs downstream of said isolating means and generating electrical signals that are indicative of the tension sensed in each web.

27. Apparatus as defined in claim 26 including processing means being adapted to receive said tension indicating signals from said tension sensing means, said processing means being adapted to generate said control signals for controlling said output drive means to drive said combined webs at a speed that produces said desired tension level in at least one of said webs, said tension level in the other of said webs approaching said desired tension level when the tension levels of each of the webs is approximately equal.

28. Apparatus for applying a longitudinal fold to a paper web printing press of the type which has at least one printing station and at least one forming station, said apparatus being interposed between one of said printing stations and one of said forming stations, said apparatus having an input where said web tension upstream of the input has a generally predetermined first tension range, and an output where said web is output at a generally predetermined second tension range, said apparatus comprising:

means for receiving the web and for controlling the tension of the web in said apparatus adjacent said input;

means adjacent said output for presenting the web to the downstream portion of the printing press including the forming station, said presenting means being adapted to isolate the tension in the web downstream of the output from the tension upstream thereof to thereby provide a generally predetermined third tension range between the input and output that is lower than each of said generally predetermined first and second tension ranges;

means for folding the web along the longitudinal direction of the web, said folding means being located between the input and output so that folding occurs with the web being at said generally predetermined third tension range.

29. Apparatus for applying a longitudinal fold to a paper web printing press of the type which has at least one printing station and at least one forming station, said apparatus being interposed between one of said printing stations and one of said forming stations, said apparatus having an input where said web tension upstream of the input has a generally predetermined first tension range, and an output where said web is output at a generally predetermined second tension range, said apparatus comprising:

means for receiving the web and for controlling the tension of the web in said apparatus adjacent said input;

means adjacent said output for presenting the web to the downstream portion of the printing press including the forming station, said presenting means being adapted to isolate the tension in the web downstream of the output from the tension upstream thereof;

one of said receiving means and said presenting means controlling the tension of the web to thereby provide a generally predetermined third tension range between the input and output that is lower than each of said generally predetermined first and second tension ranges;

means for folding the web along the longitudinal direction of the web, said folding means being located between the input and output so that folding occurs with the web being at said generally predetermined third tension range.

30. A method of folding at least one web of paper along a longitudinal direction in a printing press of the type which has at least one source of paper, at least one printing station, at least one folding station and at least one output station, the web moving downstream from the source to the printing station and to the output station, the output station being of the type which applies a first generally predetermined tension to the web upstream of the output station, said method comprising the steps of:

isolating the web so that the tension of the web at the folding station is controlled to be lower than the tension of the web upstream of the output station and downstream of the printing station;

folding the web at said folding station by drawing the web over a folding means while the web is at a second generally predetermined tension.

31. A method as defined in claim 30 wherein said folding step comprises drawing the web over a plow folding means whereby at least a portion of the web is folded over onto itself.

32. A method of folding at least two webs of paper along a longitudinal direction in a printing press of the type which has at least two sources of paper, at least two printing stations, at least one folding station and at least one output station, the webs moving downstream from the sources to the printing stations and to the output station, the output station being of the type which applies a first generally predetermined tension to the webs upstream of the output station, said method comprising the steps of:

isolating the webs so that the tension of the webs at the folding station is controlled to be lower than the tension of the webs on both sides of the folding station;

combining the two webs so that they are in overlying relation with one another;

folding the webs at said folding station by drawing the webs over a folding means while at least one of the webs is at a second generally predetermined tension.

33. A method as defined in claim 32 wherein said folding step comprises drawing the webs over a plow folding shoe whereby at least a portion of the width of the combined webs are folded over onto the remaining portion of the combined webs.

34. A method of folding at least one web of paper along a longitudinal direction in a printing press of the type which has at least one source of paper, at least one printing station, at least one folding station and at least one output station, the web moving downstream from the source through the printing station to the output station, the output station being of the type which applies a first generally predetermined tension to the web upstream of the output station, said method comprising the steps of:

measuring the tension of the web at at least one predetermined location within the folding station;

controlling the tension of the web while it is in the folding station;

folding the web at said folding station by drawing the web over a folding means while the web is at a second generally predetermined reduced tension.

35. A method as defined in claim 34 wherein said step of measuring the tension of the web occurs at a location near where the web enters the folding station.

36. A method as defined in claim 34 wherein the step of controlling the tension of the web upstream of its entering the folding station comprises wrapping the web around an input cylinder to isolate the tension on the web upstream of said input cylinder from the tension on the web that is downstream of the input cylinder.

37. A method as defined in claim 34 wherein the step of controlling the tension of the web downstream of its exit from the folding station comprises wrapping the web around an output cylinder to isolate the tension on the web upstream of said output cylinder from the tension on the web that is downstream of the output cylinder.

38. A method as defined in claim 37 wherein said controlling step further comprises driving said output cylinder at a predetermined speed that is incrementally slower than the web speed that would otherwise occur, thereby increasing the tension in the web downstream of the output cylinder, while decreasing the tension in the web between said input and output cylinders.

39. A method as defined in claim 34 wherein said output station comprises a forming unit adapted to combine a plurality of webs and fold one or more webs into smaller portions, and to cut the webs into sections of finite length.

40. A method of folding a longitudinal web in a folding zone of a printing press of the type which has an output station that normally applies a first predetermined tension to the web upstream of the output station, a source of web of the type which is adapted to apply tension to the web, at least one printing station located between said source and said output station, the folding zone being located between the output station and the printing station, said method comprising:

isolating the tension of the web as it enters and leaves the folding zone so that the tension of the web within the folding zone can be controlled to a value that is lower than the tension of the web upstream and downstream of the folding zone;

controlling the tension of the web at said lower tension within the folding zone; and, folding the web along its length within the folding zone.

* * * * *